US005842624A

United States Patent [19]

Ishida

[11] Patent Number: 5,842,624

[45] Date of Patent: Dec. 1, 1998

[54] STAPLER UNIT IN WHICH A STAPLER MAIN BODY IS SWINGABLE ABOUT ITS BINDING PORTIONS

[75] Inventor: Masaki Ishida, Ebina, Japan

[73] Assignee: Fuji Xerox Co., Ltd., Tokyo, Japan

[21] Appl. No.: 720,151

[22] Filed: Sep. 25, 1996

[30] Foreign Application Priority Data

Sep. 28, 1995 [JP] Japan ..... 7-250274

[51] Int. Cl.[6] ..... B27F 7/02

[52] U.S. Cl. ..... 227/111; 227/110; 227/148

[58] Field of Search ..... 227/101, 100, 227/110, 144, 140, 143, 148, 111, 156; 270/37

[56] References Cited

U.S. PATENT DOCUMENTS

| | | | |
|---|---|---|---|
| 1,871,922 | 8/1932 | Simmons | 227/148 |
| 3,398,872 | 8/1968 | Monahan | 227/110 |
| 3,894,670 | 7/1975 | Giebel | 227/110 |
| 4,313,670 | 2/1982 | Caldwell | 227/110 |

FOREIGN PATENT DOCUMENTS

| | | |
|---|---|---|
| A-4-82793 | 3/1992 | Japan . |
| A-6-282135 | 10/1994 | Japan . |

*Primary Examiner*—Scott A. Smith
*Attorney, Agent, or Firm*—Oliff & Berridge, PLC

[57] ABSTRACT

A pivot is provided on or in the vicinity of the axis of binding portions of a stapler main body, and rotatably supports a front end portion of a stapler main body. A driving system swings the stapler main body about the pivot within a given angular range. Having the above pivot and driving system, a binding angle changing mechanism changes a binding angle formed by the side of recording sheets and the stapler main body by use of drive force of the driving system. An advance/retreat mechanism advances or retreats the stapler main body perpendicularly to the side of the recording sheets between a retreat position that is distant from a subject end portion of the recording sheets and a binding position where the binding portions are to bite the subject end portion.

2 Claims, 5 Drawing Sheets

STAPLER UNIT IN WHICH A STAPLER MAIN BODY IS SWINGABLE ABOUT ITS BINDING PORTIONS

BACKGROUND OF THE INVENTION

1. Field of the Invention

The present invention relates to a stapler unit for stapling recording sheets that have been distributed by and stored in a sheet distribution and storage apparatus such as a sorter after being discharged from an image recording apparatus such as a copier or a printer.

2. Description of the Related Art

In general, there are two methods of stapling recording sheets that have been distributed by and stored in a sheet distribution and storage apparatus and arranged therein on a page-by-page basis or in the order of pages. In the first method, recording sheets stored in a tray are supplied, by means of a sheet feed mechanism such as a gripper, to a stapler main body that actually performs stapling. In the second method, a stapler main body side is moved toward recording sheets stored in a tray. Due to a positional deviation of recording sheets in a stapling operation and complexity of the mechanical structure, the second method is disadvantageous in accuracy and cost. Therefore, recently the second method is mainly employed.

A stapler unit employing the second method is disclosed in Japanese Unexamined Patent Publication No. Hei. 4-82793. This stapler unit is composed of a processing position moving system for moving a stapler main body along the end portion of a bin tray to set it at a desired stapling position, and an advance/retreat system for advancing the stapler main body toward the bin tray at the stapling position. This stapler unit can perform not only stapling at any desired position along the side of recording sheets stored in the bin tray, but also "corner stapling" in which a staple is driven into a corner portion of recording sheets at a given angle.

However, the stapler unit disclosed in the above publication has a problem that the stapling cannot always be performed properly for any of various storage conditions such as the size of recording sheets, the recording sheet setting direction in the bin tray, and the image information recording direction on recording sheets.

Japanese Unexamined Patent Publication No. Hei. 6-282135 a stapler unit which can properly staple various kinds of recording sheets. This stapler unit has a binding angle changing means for changing a binding angle formed by the end portion of recording sheets and a stapler main body at a stapling position, whereby a staple can be driven into the end portion of recording sheets at a desired angle.

However, in this conventional stapler unit has, as the binding angle changing means, a configuration in which the stapler main body is mounted on a half-doughnut-shaped guide rail and it conducts a circular movement along the guide rail. Therefore, in performing "corner stapling," part of mechanical parts (the guide rail, stapler main body, etc.) of the stapler unit projects outward to a large extent from a sheet corner portion. Therefore, an extra space is needed to accommodate the projected portions, resulting in increase in the size of the sheet distribution and storage apparatus.

SUMMARY OF THE INVENTION

An object of the present invention to provide a stapler unit which can minimize the degree of projection of mechanical parts from a corner portion of recording sheets in driving a staple into the sheet corner portion obliquely with respect to the side of the recording sheets.

According to the invention, there is provided a stapler unit comprising:

a stapler main body having binding portions in a front end portion thereof, for stapling an end portion of recording sheets stored in a tray in a state that the end portion of the recording sheets is set between the binding portions;

stapler moving means for moving the stapler main body along a side of the recording sheets;

binding angle changing means comprising:

a pivot provided on or in the vicinity of an axis of the binding portions, for rotatably supporting the front end portion of the stapler main body; and a driving system for swinging the stapler main body about the pivot within a given angular range, wherein the binding angle changing means changes a binding angle formed by the side of the recording sheets and the stapler main body by using drive force of the driving system; and advance/retreat means for advancing or retreating the stapler main body perpendicularly to the side of the recording sheets between a retreat position that is distant from the side of the recording sheets and a binding position where the binding portions are to bite the end portion of the recording sheets.

In the above-structured stapler unit, a corner stapling operation is performed in the following manner. The stapler main body is moved to a position facing a subject corner portion of recording sheets by the stapler moving means and a staple is driven into the corner portion obliquely with respect to the side of the recording sheets. More specifically, the stapler main body is swung about the pivot by the binding angle changing means so that the binding angle is set at a given angle (for example, 45°). In this state, the stapler main body is moved by the advance/retreat means perpendicularly to the side of the recording sheets, that is, the stapler main body is advanced from the retreat position to the binding position, and stapling is performed there. In the above operation, the stapler main body swings about the pivot that is located on or in the vicinity of the axis of the binding portions to change the binding angle arbitrarily. Therefore, the amount of projection of the mechanical parts from the corner portion of the recording sheets can be restricted to the range of swing of the stapler main body about the pivot, that is, the amount of projection can be reduced to a minimum necessary range.

DESCRIPTION OF THE PREFERRED EMBODIMENTS

Figure 1:
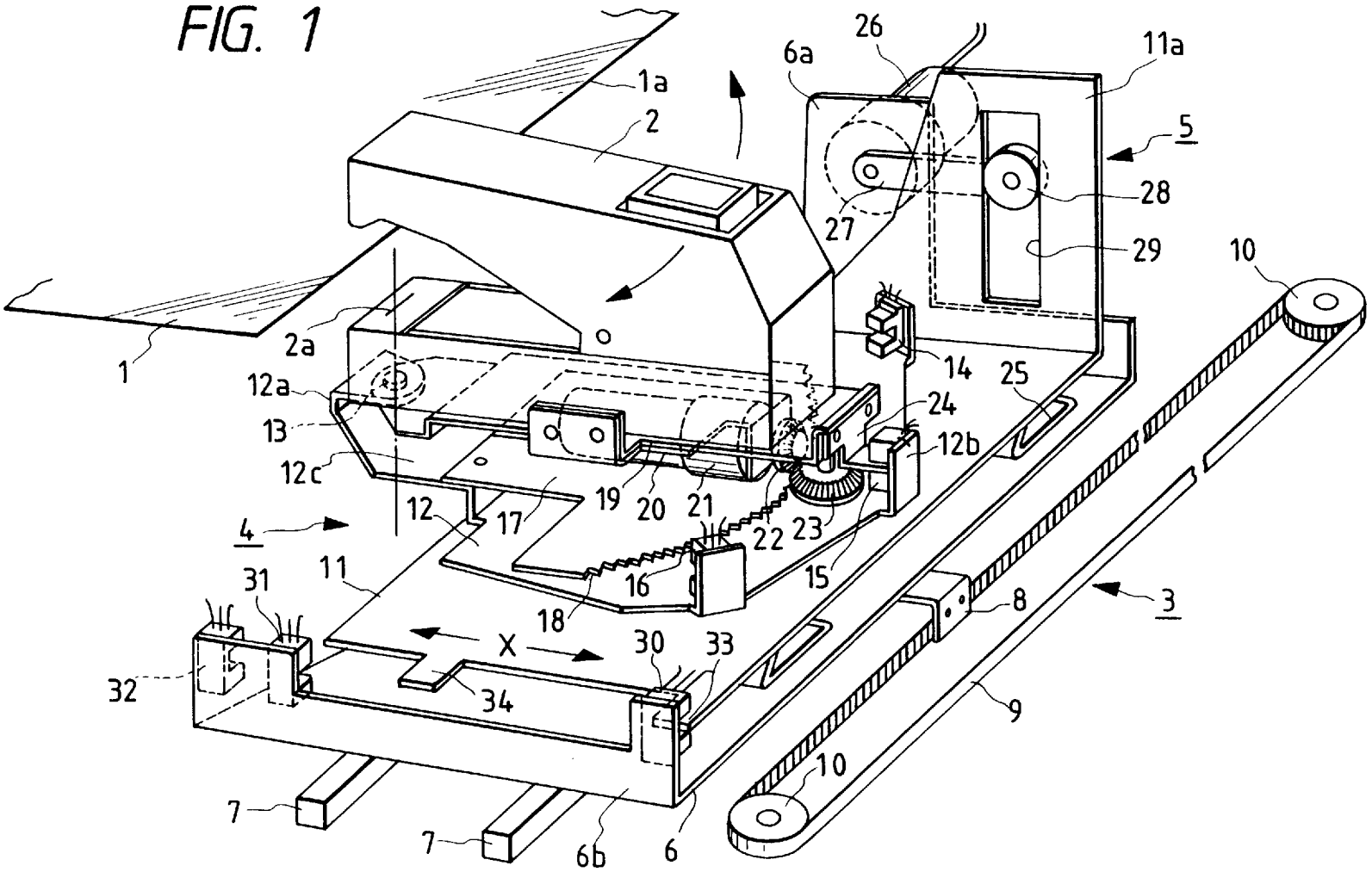
FIG. 1 is a perspective view of a stapler unit according to an embodiment of the present invention.

FIG. 1 is a perspective view of a stapler unit according to an embodiment of the present invention.

The stapler unit shown in FIG. 1 is used to drive a staple into an end portion of recording sheets 1 stored in a tray (not shown). The stapler unit consists mainly of a stapler main body 2, a stapler moving mechanism 3 for moving the stapler main body 2 along a side 1*a* of the recording sheets 1, a binding angle changing mechanism 4 for changing a biding angle formed by the side 1*a* of the recording sheets 1 and the stapler main body 2, and an advance/retreat mechanism 5 for advancing or retreating the stapler main body 2 in direction X that is perpendicular to the side 1*a* of the recording sheets 1.

Having a binding portion 2*a* in its front end portion (an upper binding portion is hidden in FIG. 1), the stapler main body 2 carries out stapling in a state that an end portion of the recording sheets 1 is set above the binding portion 2*a*.

The stapler moving mechanism 3 comprises a base cart 6 on which the stapler main body 2 is mounted, a pair of guide rails 7 for guiding and supporting the base cart 6 movably along the side 1*a* of the recording sheets 1, a timing belt 9 screwed to a projection piece 8 of the base cart 6, and a pair of pulleys around which the timing belt 9 parallel with the guide rails 7 wound with proper tension. Also provided is a drive motor (not shown) which exerts rotational force on one of the pulleys 10.

In the above-configured stapler moving mechanism 3, when the drive motor (not shown) is rotated, the timing belt 9 is fed in one direction by the rotation of the pulley 10 in accordance with to the rotational direction of the drive motor. When the rotation of the drive motor is reversed, the timing belt 9 is rotated in the opposite direction. As a result, the base cart 6, which is connected to the timing belt 9 through the projection piece 8, is caused to run on the guide rails 7, and hence the stapler main body 2 mounted on the base cart 6 is moved along the side 1*a* of the recording sheets 1. In this embodiment, a stepping motor is employed as the drive motor. Therefore, the position of the stapler main body 2 along the side 1*a* of the recording sheets 1, that is, the position of stapling on an end portion of the recording sheets 1 can be set arbitrarily based on drive pulses that are applied to the stepping motor.

The binding angle changing mechanism 4 is constructed on a base plate 11 mounted on the base cart 6. A housing seat 12 is fixed to the top surface of the base plate 11. A front end portion 12*a* of the housing seat 12 is bent to assume a hook-like shape and formed with a pivot 13. Three sensor mounting pieces 12*b* are erected from a rear end portion of the housing seat 12. The three sensor mounting pieces 12*b* are respectively provided with binding angle detection sensors (photo-interrupters) 14–16 each consisting of a light emitting element and a photodetecting element, for instance. A rack plate 17 is fixed to a front elevated portion 12*c* of the housing seat 12 with screws, for instance. The rack plate 17 is formed with a rack 18 at its periphery such that the rack 18 assumes an arc having the pivot 13 as the center.

The stapler main body 2 is mounted on the housing seat 12 through a stapler seat 19. The stapler main body 2, which is fixed to the stapler seat 19, has the binding portion 2*a* in its front end portion as described above, and the pivot 13 is disposed on or in the vicinity of the vertical axis of the binding portion 2*a* (on the axis of the binding portion 2*a* in FIG. 1). The pivot 13 is engaged with the front end portion of the stapler main body 2 at a position on or in the vicinity of the axis of the binding portion 2*a*, whereby the pivot 13 supports the front end portion of the stapler main body 2 in a rotatable manner.

A bracket 20 is attached to the bottom surface of the stapler seat 19, and accommodates a drive motor 21 for changing the binding angle. A motor gear (bevel gear) 22 is mounted on the output shaft of the drive motor 21, is in mesh with a pinion 23. The pinion 23 has an integral structure of a bevel gear and a spur gear which are in mesh with the motor gear 22 the rack 18 of the rack plate 17, respectively. Further, the rear end portion of the staple seat 19 is provided with a projection 24 for changing the output levels of the above-mentioned three binding angle detection sensors 14–16.

Figure 2:
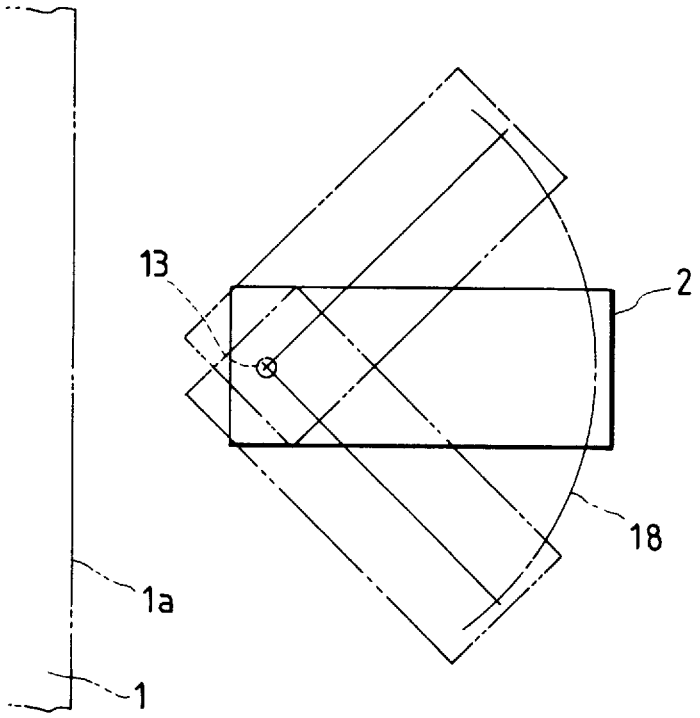
FIG. 2 illustrates the operation of a binding angle changing mechanism.

In the above-configured binding angle changing mechanism 4, when the drive motor 21 serving as a drive source is rotated, resulting drive force is transmitted through the motor gear 22 to the pinion 23. The pinion 23 is rotated with the rotation of the drive motor 21, so that the pinion 23 moves around the rack 18 while being engaged with it. As a result, as shown in FIG. 2, the stapler main body 2 is swung about the pivot 13 in accordance with the amount and the direction of the rotation of the pinion 23. Thus, the binding angle formed by the stapler main body 2 and the side 1*a* of the recording sheets 1 can be changed as desired. If the projection 24 is inserted into the optical path of one of the binding angle detection sensors 14–16 during a swing of the stapler main body 2, the output of the sensor changes from a high level to a low level. Therefore, the binding angle can be detected based on which sensor output turns low.

The rack 18 of the rack plate 17 is so formed as to cover at least a 90° range around the pivot 13, because the standard binding angle in a case where a staple is driven into a corner portion of the recording sheets 1 obliquely with respect to the their side 1*a* is 45°.

The advance/retreat mechanism 5 has a pair of guide members 25 for movably guiding and supporting the base plate 11 that carries the stapler main body 2 in direction X, that is, perpendicularly to the side 1*a* of the recording sheets 1, as well as a drive motor 26 mounted on a side wall 6*a* of the base cart 6. A proximal end portion of a swing arm 27 is fixed to the output shaft of the drive motor 26. A cam roller 28 is mounted on a free end portion of the swing arm 21. An oblong slit 29 is formed in a side wall 11*a* of the base plate 11. The cam roller 28 is movably engaged with the slit 29.

Figure 3:
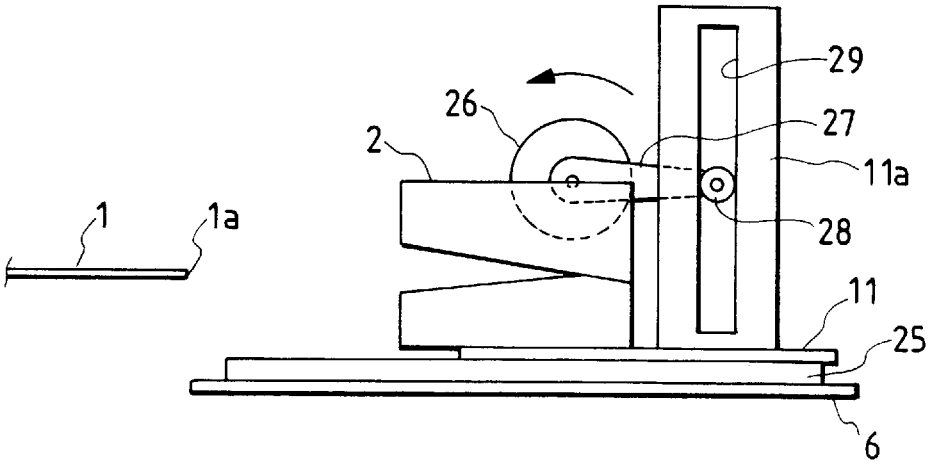
FIGS. 3 and 4 illustrate the operation of an advance/retreat mechanism.
Figure 4:
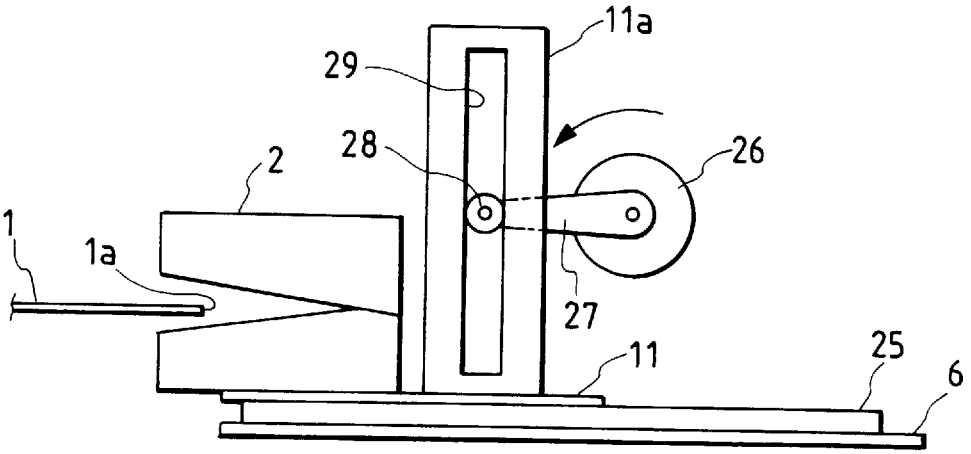

In the above-structured advance/retreat moving mechanism 5, when the drive motor 26 serving as a drive source is rotated, the swing arm 21 mounted on its output shaft is swung and accordingly the cam roller 28 is moved vertically along the slit 29. That is, a swing of the swing arm 27 is converted into a straight movement of the base plate 11 along the guiding direction of the guide members 25, so that the stapler main body 2 advances or retreats on the base cart 6 together with the base plate 11. In this manner, the advance/retreat mechanism 5 can move the stapler main body 2 that is mounted on the base plate 11 perpendicularly to the side 1*a* of the recording sheets 1 between a retreat position (see FIG. 3) that is away from an end portion of the recording sheets 1 and a binding position (see FIG. 4) where the stapler main body 2 can bite the end portion of the recording sheets 1.

Further, the advance/retreat mechanism 5 is provided with a binding position correction means for correcting the binding position in accordance with the binding angle that is set by the binding angle changing mechanism 4 which means includes a position sensor (photo-interrupter) 30 for detecting that the stapler main body 2 has reached the retreat position and two position sensors 31 and 32 for detecting that the stapler main body 2 has reached the binding position. The position sensors 30–32 are attached to the sensor mounting wall 6*b* of the base cart 6. A pair of projections 33 and 34 project from the side of the base plate 11 at positions having proper relationships with the mounting positions of the sensors 30–32. When the stapler main body 2 is located at the retreat position, the projection 33 is inserted in the position sensor 30, so that the output signal of the position sensor 30 is kept at a low level. On the other hand, when the stapler main body 2 is advanced to the binding position being driven by the drive motor 26, the other projection 34 is inserted into one of the two position sensors 31 and 32 depending on the binding angle set by the binding angle changing mechanism 4. The drive motor 26 is stopped when the output signal of the projection-inserted position sensor 31 or 32 turns low.

Figure 6:
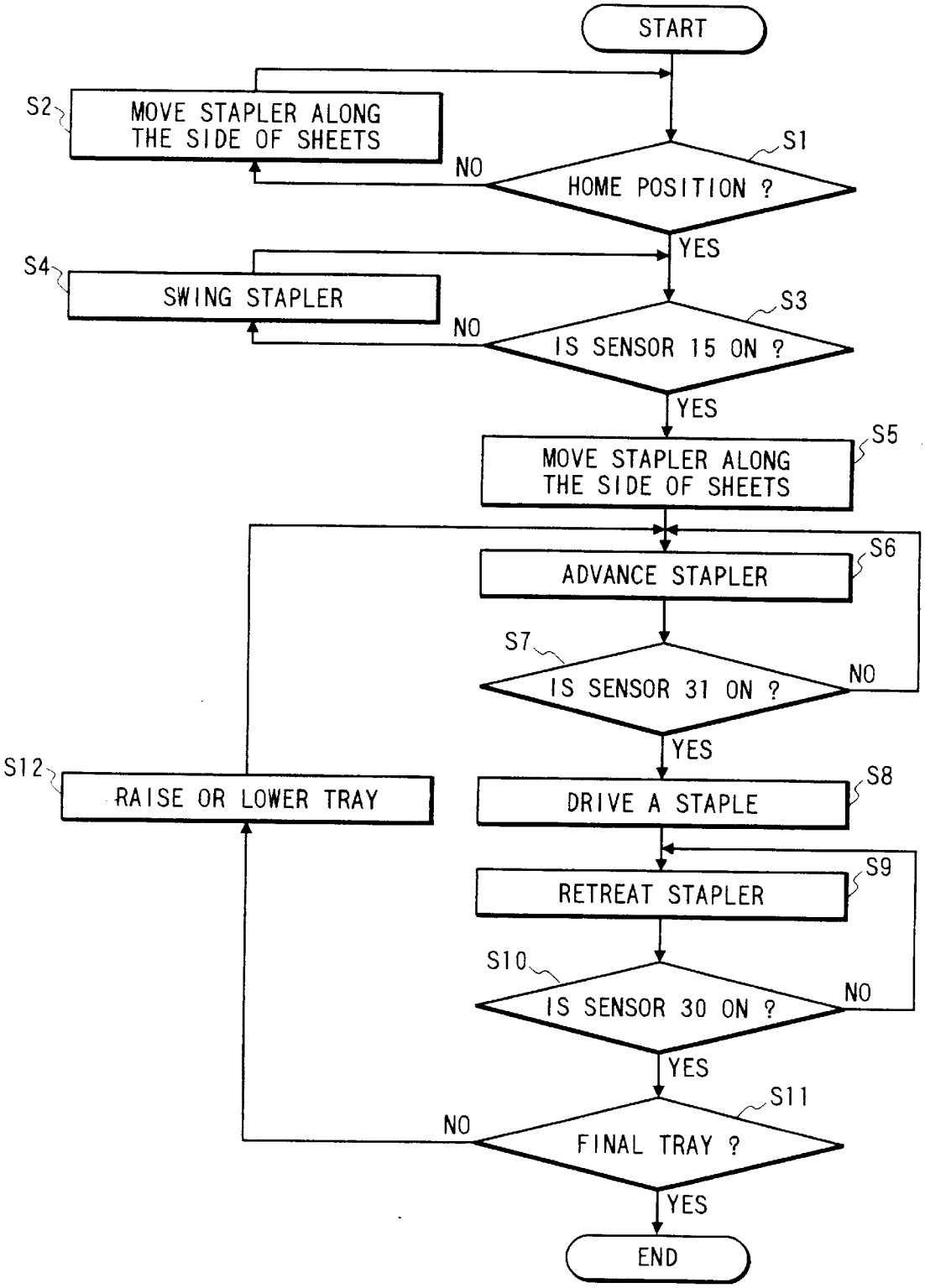
FIG. 6 is a flowchart showing an operation procedure of the stapler unit.

Next, referring to a flowchart of FIG. 6, a description will be given of how the stapler unit operates when actually incorporated in a sheet distribution and storage apparatus. There are two kinds of stapling operations: straight stapling in which a staple is driven into recording sheets 1 parallel with their side 1*a*, and corner stapling in which a staple is driven into recording sheets 1 obliquely with respect to their side 1*a* at a given angle. The flowchart of FIG. 6 is directed to the straight stapling.

First, when the stapling process is started upon distribution and storage of recording sheets 1 into a bin tray, it is checked whether the stapler main body 2 is located at a predetermined home position (S1). If the stapler main body 2 is not at the home position, the stapler moving mechanism 3 is driven to move the stapler main body 2 along the side 1*a* of the recording sheets 1 to the predetermined home position (S2).

When the stapler main body 2 has reached the home position, it is checked based on output levels of the three binding angle detection sensors 14–16 whether a binding angle formed by the side 1*a* of the recording sheets 1 and the stapler main body 2 is set equal to a binding angle specified by an operator (S3). In this example, the binding angle specified by the operator is of straight stapling. Therefore, it is checked whether an output signal of the binding angle detection sensor 15 is in an on state (i.e., at a low level) due to insertion of the projection 24.

Figure 7A:
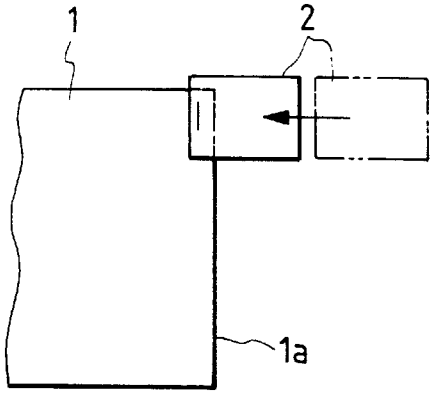
FIGS. 7A–7C illustrate various stapling operations.

If the binding angle detection sensor 15 is not on, the binding angle changing mechanism 4 is driven to swing the stapler main body 2 about the pivot 13 (S4). The process goes to the next step at a time point when the binding angle detection sensor 15 is turned on as a result of the swing of the stapler main body 2, that is, a time when the stapler main body 2 is set perpendicular to the side 1*a* of the recording sheets 1 as shown in FIG. 7A.

Next, if A4 is designated by the operator as the size of recording sheets 1, the stapler moving mechanism 3 is driven until the stapler main body 2 reaches a straight staling position for A4 (S5).

Thereafter, by driving the advance/retreat moving mechanism 5, the stapler main body 2 is advanced toward the binding position (S6). Then It is checked based on an output signal of the position sensor 31 whether the stapler main body 2 has reached a binding position for the binding angle of the straight stapling (S7). The process goes to the next step at a time when the output signal of the position sensor 31 is turned on (becomes a low level) due to insertion of the projection 34, that is, at a time point when the stapler main body 2 just reaches a binding position indicated by a solid line in FIG. 7A as a result of advance from the retreat position indicated by a two-dot chain line.

In this embodiment, the advance length of the stapler main body 2 in the straight stapling and that in the corner stapling are controlled separately from each other. This is because if the binding position as measured from the side 1*a* of the recording sheets 1 is set the same for the straight stapling and the corner stapling, one of actual staple driving positions becomes inappropriate. That is, if a corner stapling operation is performed at a position suitable for a straight stapling operation, one end of the driven staple is too close to the side 1*a* of the recording sheets 1. Conversely, if a straight stapling operation is carried out at a position suitable for a corner stapling operation, the driven staple is too distant from the side 1*a* of the recording sheets 1.

Figure 5:
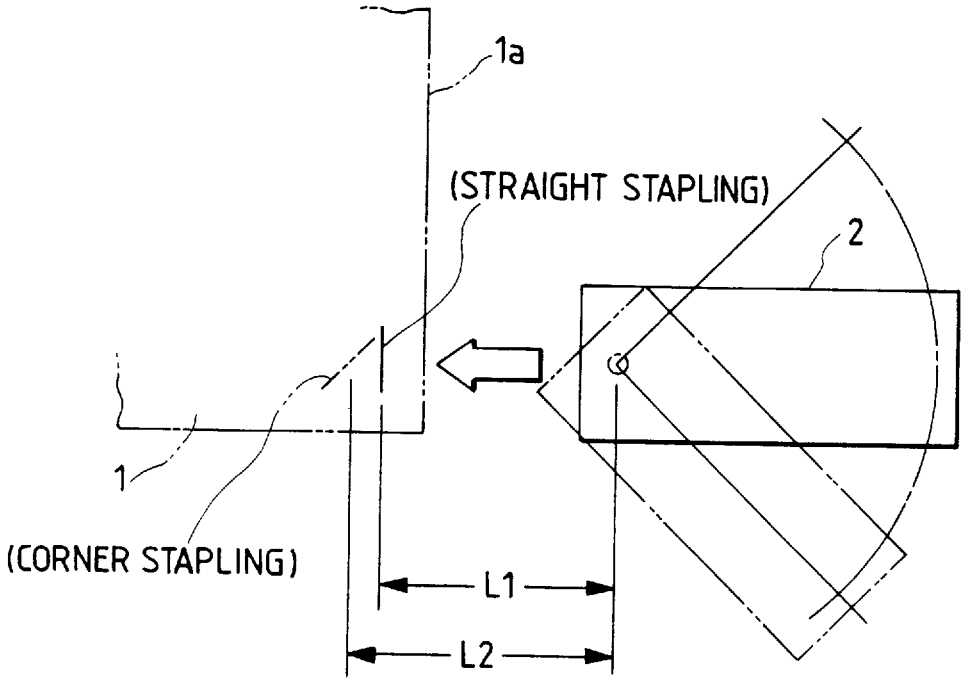
FIG. 5 illustrates a relationship between a binding angle and a binding position.

This embodiment is configured in view of the above. That is, as shown in FIG. 5, in a straight stapling operation, the output signal of the position sensor 31 turns on due to insertion of the projection 34 at a time point when the movement distance of the stapler main body 2 reaches L1, and the driving of the advance/retreat mechanism 5 is stopped at this time point. On the other hand, in a corner stapling operation, the output signal of the position sensor 32 turns on due to insertion of the projection 34 at a time point when the movement distance of the stapler main body 2 reaches L2 which is greater than L1, and the driving of the advance/retreat mechanism 5 is stopped at this time point.

After the stapler main body 2 is positioned at a binding position for straight stapling in the above manner, the stapler main body 2 drives a staple into the end portion of the recording sheets 1 that are set above the binding portion 2*a* (S8). Upon completion of the staple driving by the stapler main body 2, the advance/retreat mechanism 5 is driven to retreat the stapler main body 2 toward the retreat position (S9). It is judged based on the output signal of the position sensor 30 whether the stapler main body 2 has reached the retreat position (S10). The process goes to the next step when the output signal of the position sensor 30 turns on (becomes a low level) due to insertion of the projection 33.

Thereafter, it is judged whether the current stapling operation is directed to the final bin tray (S11). If it is judged that there remains a bin tray for stapling, the bin trays are raised (or lowered) by one pitch (S12) and steps S6–S10 are repeated. At a time point when a binding operation on recording sheets 1 stored in the final bin tray is finished, the stapling process is ended.

Figure 7B:
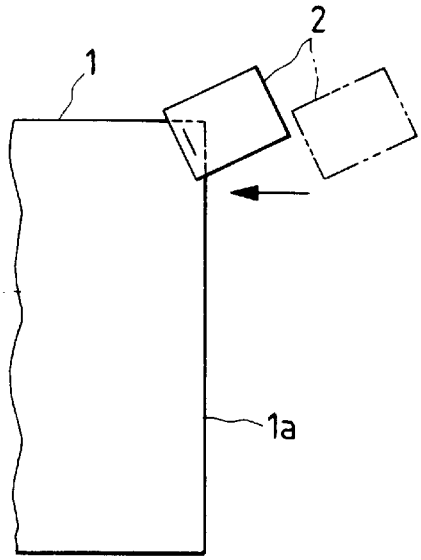

On the other hand, where a corner stapling operation is performed on the deep-side corner (as viewed in FIG. 1) of the two corners of the recording sheets 1, in steps S3 and S4 the binding angle change mechanism 4 is driven until the binding angle detection sensor 14 is turned on, to thereby swing the stapler main body 2 about the pivot 13. As a result, as shown in FIG. 7B, the stapler main body 2 is inclined at a given angle (45° in ordinary corner stapling) with respect to the side 1*a* of the recording sheets 1. In step S5, the stapler moving mechanism 3 is driven to move the stapler main body 2 to a position facing the deep-side corner portion. In steps S6 and S7, the advance/retreat mechanism 5 is driven until the position sensor 32 is turned on, so that the stapler main body 2 advances from the retreat position indicated by a two-dot chain line in FIG. 7B to a predetermined binding position indicated by a solid line. As a result, the stapler main body 2 is positioned at a binding position suitable for the corner stapling operation (see FIG. 5). At this position, the stapler main body 2 drives a staple into the recording sheets 1 (S8). The subsequent processing is similar to the case of the above-described straight stapling operation.

Figure 7C:
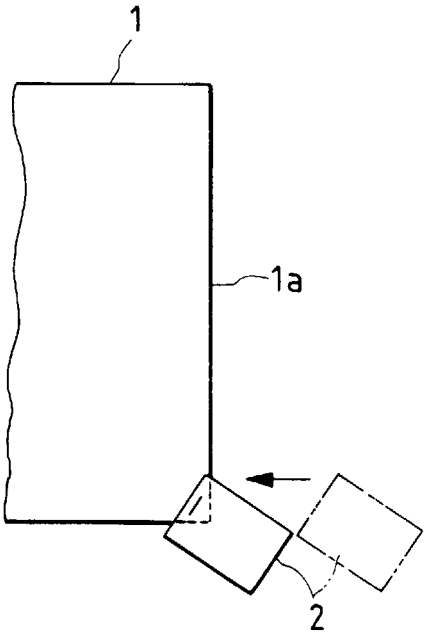

On the other hand, where a corner driving operation is performed on the viewer's side corner (as viewed in FIG. 1), in steps S3 and S4, the binding angle change mechanism 4 is driven until the binding angle detection sensor 16 is turned on, to thereby swing the stapler main body 2 about the pivot 13. As a result, as shown in FIG. 7C, the stapler main body 2 is inclined at a given angle with respect to the side 1*a* of the recording sheets 1 in a direction opposite to the direction of the above case. In step S5, the stapler moving mechanism 3 is driven to move the stapler main body 2 to a position facing the viewer's side corner portion. In steps S6 and S7, as in the above case, the advance/retreat mechanism 5 is driven until the position sensor 32 is turned, so that the stapler main body 2 advances from the retreat position indicated by a two-dot chain line in FIG. 7C to a predetermined binding position (suitable for corner stapling) indicated by a solid line. The subsequent processing is similar to the case of the above-described corner stapling operation on the deep-side corner portion.

As described above, in the stapler unit according to the embodiment, where a corner stapling operation is carried out on a corner portion (on the deep side or the viewer's side), the binding angle is set by swinging the stapler main body 2 about the pivot 13 provided on or in the vicinity of the axis of the binding portion 2*a*, and the stapler main body 2 is always advanced or retreated perpendicularly to the side 1*a* of the recording sheets 1 with the thus-set binding angle is maintained. Therefore, the range occupied by the stapler main body 2 in changing the binding angle is limited to a range defined by a swing about the pivot 13 of the rear end of the stapler main body 2. As a result, the projection of the mechanism parts of the stapler unit from a sheet corner portion can be reduced to a minimum necessary level and hence a space allowing for such projection can also be minimized. Thus, the space that needs to be secured around a sheet corner portion can be reduced greatly from the conventional case where the stapler main body is moved along the half-doughnut-shaped guide rail.

Further, in the stapler unit according to the embodiment, since the binding position of the stapler main body 2 to be set by the advance/retreat mechanism 5 is corrected based on the output signals of the two position sensors 31 and 32 in accordance with the binding angle set by the binding angle changing mechanism 4, a staple can always be driven, at an optimum position, into an end portion of the recording sheets 1 regardless of the binding angle.

In the above embodiment, the binding angle changing mechanism 4 and the advance/retreat mechanism 5 are configured such that the binding angle or the binding position is set by the drive amount of the drive motor which is determined based on the sensor output. However, the invention is not limited to such a case. For example, the binding angle and the binding position can be set arbitrarily by employing stepping motors as the drive motors 21 and 26, and swinging or advancing/retreating the stapler main body 2 by applying drive to the drive motor.

As described above, in the stapler unit according to the invention, since a staple can be driven at an arbitrary binding angle, a proper stapling operation can be performed on recording sheets that are stored under any of various storage conditions. In the case of a corner stapling operation, the binding angle is set by swinging the stapler main body about the pivot that is located on or in the vicinity of the axis of the binding portion, and the stapler main body is advanced from the retreat position to the binding position. This configuration allows reduction in the amount of projection of the mechanism parts from a sheet corner portion as compared to the conventional stapler unit. As a result, the space that needs to be secured around a sheet corner portion can be reduced, which in turn makes it possible to reduce the size of the sheet distribution and storage apparatus.

What is claimed is:

1. A stapler unit comprising:

a stapler main body having binding portions in a front end portion thereof, for stapling an end portion of recording sheets stored in a tray in a state that the end portion of the recording sheets is set between the binding portions;

stapler moving means for moving the stapler main body along a side of the recording sheets;

binding angle changing means comprising:

a pivot provided on or in the vicinity of an axis of the binding portions, for rotatably supporting the front end portion of the stapler main body; and a driving system for swinging the stapler main body about the pivot within a given angular range, wherein the binding angle changing means changes a binding angle formed by the side of the recording sheets and the stapler main body by using drive force of the driving system; and advance/retreat means for advancing and retreating the stapler main body perpendicularly to the side of the recording sheets between a retreat position that is distant from the side of the recording sheets and a binding position where the binding portions are to bite the end portion of the recording sheets.

2. The stapler unit according to claim 1, wherein the advance/retreat means comprises binding position correction means for correcting the binding position in accordance with the binding angle.

* * * * *